United States Patent [19]

Haworth

[11] Patent Number: 4,627,248

[45] Date of Patent: Dec. 9, 1986

[54] TRAILER DOOR LOCK SYSTEM

[75] Inventor: David L. Haworth, Papillion, Nebr.

[73] Assignee: Sentry Lock Co., Inc., Gretna, Nebr.

[21] Appl. No.: 779,041

[22] Filed: Sep. 23, 1985

[51] Int. Cl.[4] ..... E05C 3/14; E05B 65/14

[52] U.S. Cl. ..... 70/134; 292/207; 292/218; 292/337; 292/DIG. 32

[58] Field of Search ..... 70/134, 455; 292/218, 292/207, 140, 147, 337, DIG. 32

[56] References Cited

U.S. PATENT DOCUMENTS

| | | | |
|---|---|---|---|
| 1,579,107 | 3/1926 | Hanle | 292/207 X |
| 2,083,796 | 6/1937 | Schlage | 70/134 |
| 3,197,247 | 7/1965 | Russell | 292/337 X |
| 3,815,390 | 6/1974 | Stoia | 70/134 |
| 4,023,388 | 5/1977 | Morvai | 70/455 |
| 4,057,273 | 11/1977 | Carr | 292/218 |
| 4,136,540 | 1/1979 | Coralli et al. | 70/134 X |
| 4,157,653 | 6/1979 | Dohanyos | 70/134 X |
| 4,565,079 | 1/1986 | Smith | 70/134 |

*Primary Examiner*—Robert L. Wolfe
*Assistant Examiner*—Russell W. Illich
*Attorney, Agent, or Firm*—Zarley, McKee, Thomte, Voorhees & Sease

[57] ABSTRACT

A lock device for a hinged cargo door of a truck trailer has a housing with a vertically extended groove in one side wall for receiving the rotatable cargo door lock bar. A transversely extended lock pin in the housing is transversely movable through an opening in the same side wall for insertion into a registered hole in the cargo door lock bar in the locked position thereof. Transverse movement of the lock pin is controlled by a simple lock mechanism including a key operated lock shaft having a rocker arm rotatable therewith and having a free end connected to the lock pin for transverse movement of the lock pin in response to rotation of the lock shaft.

12 Claims, 4 Drawing Figures

TRAILER DOOR LOCK SYSTEM

BACKGROUND OF THE INVENTION

The present invention is directed generally to an auxiliary lock for the hinged cargo doors of truck trailers and more particularly to a lock device having a vertical groove in one side wall for receiving the rotatable door lock bar and furthermore having a transversely slidable lock pin insertable into a registered hole in the lock bar at a position inaccessible by a hacksaw, chain cutters or other tampering tools.

Break-ins present a significant security problem for the storage and transport of valuable cargo in large trailers associated with semi-tractor/trailer rigs. Refrigerated trailers for hauling meat are particularly susceptible to break-ins because of the value of the cargo and the ease with which the stolen cargo can be sold. The hinged rear trailer doors are equipped with a vertically extended rotatable lock bar having a handle which may be secured in a locked position against the door with a padlock. Chain cutters and other tools readily available to vandels, however, can quickly and easily destroy most conventional padlocks.

A known auxiliary trailer door lock requires a somewhat T-shaped catch bracket to be welded to the lock bar, the catch bracket having a transverse tubular extension for receiving a retractable lock pin from a housing mounted on the truck door. The lock pin is thus accessible in the gap between the housing and catch bracket for cutting the lock pin with a hacksaw or the like and thereby disabling the lock. The known lock furthermore included numerous parts, required many welds in the assembly thereof, depended upon a corrosion susceptible spring for opening and required the separate catch bracket to be welded to the pivotal door lock bar.

Accordingly, a primary object of the invention is to provide an improved lock system for a vehicle cargo door.

Another object is to provide an improved lock system which is simple and rugged in construction with a minimum number of moving parts.

Another object is to provide such a lock system which can be quickly and easily assembled.

Another object is to provide such a lock system wherein the lock pin thereof, in its locked position, is shielded by the housing thereof and thereby not directly accessible to a hacksaw, cutting torch or the like.

Another object is to provide a lock system which is independent and requires no auxiliary structure to be secured to the conventional door lock bar.

Another object is to provide such a lock system wherein the opening force on the lock pin is generated by the manual turning of a key.

Another object is to provide a vehicle cargo door lock system which is easy to install, inexpensive to manufacture and efficient in operation.

SUMMARY OF THE INVENTION

The vehicle cargo door lock system of the present invention includes a housing having one side wall formed with a vertically extended groove adapted for receiving the rotatable cargo door lock bar upon securement of the housing to a cargo door. An opening through the same side wall of the housing is provided for the retractable extension of an elongated lock pin from the housing, through the opening and into a registered hole in the cargo door lock bar in the locked position thereof. The lock pin is movable by a key operated lock shaft supported on the housing. A rocket arm secured to the lock shaft has a free end connected to the lock pin for transverse movement of the lock pin in response to rotation of the lock shaft. A removable key is engageable with the lock shaft for manually rotating it in opposite directions for advancing and retracting the lock pin from the cargo door lock bar.

With the lock bar received in the groove in the housing side wall, the housing effectively shields the lock pin from direct access by a hacksaw, chain cutter, cutting torch or the like. The housing is preferably of one piece aluminum construction to thereby remain corrosion free over a long useful life. The very simple mechanism for advancing and retracting the lock pin has only a minimum number of moving parts so as to be virtually trouble free. It is believed that the presence of the lock system of the present invention on the cargo doors of a trailer will so discourage vandals that their attention will be directed to other trailers not equipped with the lock system of the invention.

DESCRIPTION OF THE PREFERRED EMBODIMENT

Figure 1:
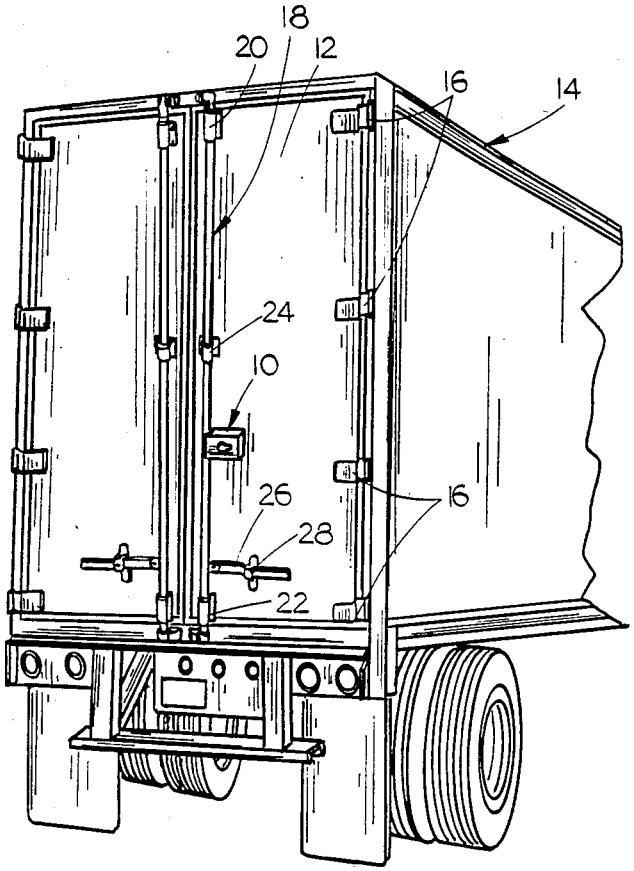
FIG. 1 is a perspective view of the cargo doors of a truck trailer with the lock system of the invention installed thereon.

The lock device 10 of the present invention is shown in FIG. 1 installed on the cargo door 12 of a truck trailer 14. The cargo door 12 is supported by a series of hinges 16 along its outer edge. A vertically extended lock bar 18 is rotatably supported adjacent the inner edge of the door by upper and lower closure members 20 and 22 and a guide bracket 24. A pivotal handle 26 on the lock bar 18 is engageable with a bracket 28 for securing the bracket in the illustrated locked position with a padlock. Because padlocks can be easily disabled with chain cutters, and other tampering tools, the accessory lock device 10 is provided to effectively discourage vandals from even attempting to break into a trailer equipped with the device.

Figure 2:
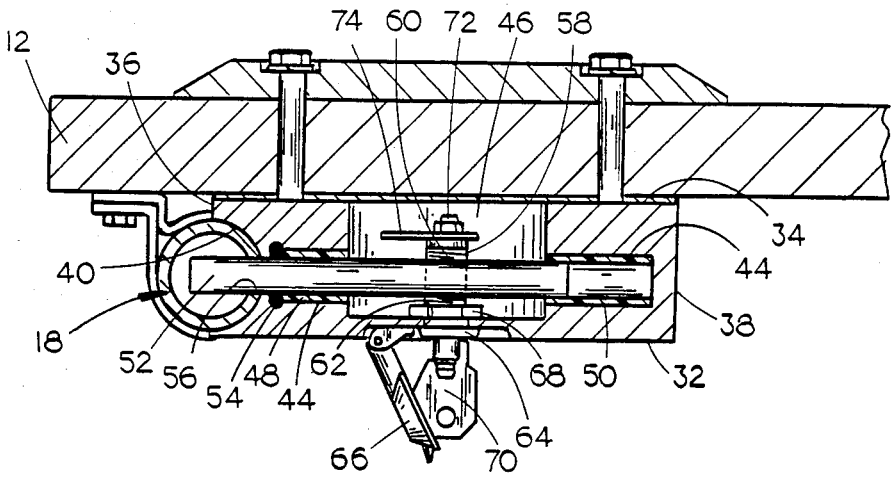
FIG. 2 is a top sectional view through the lock system as installed on a cargo door in the locked position thereof.
Figure 3:
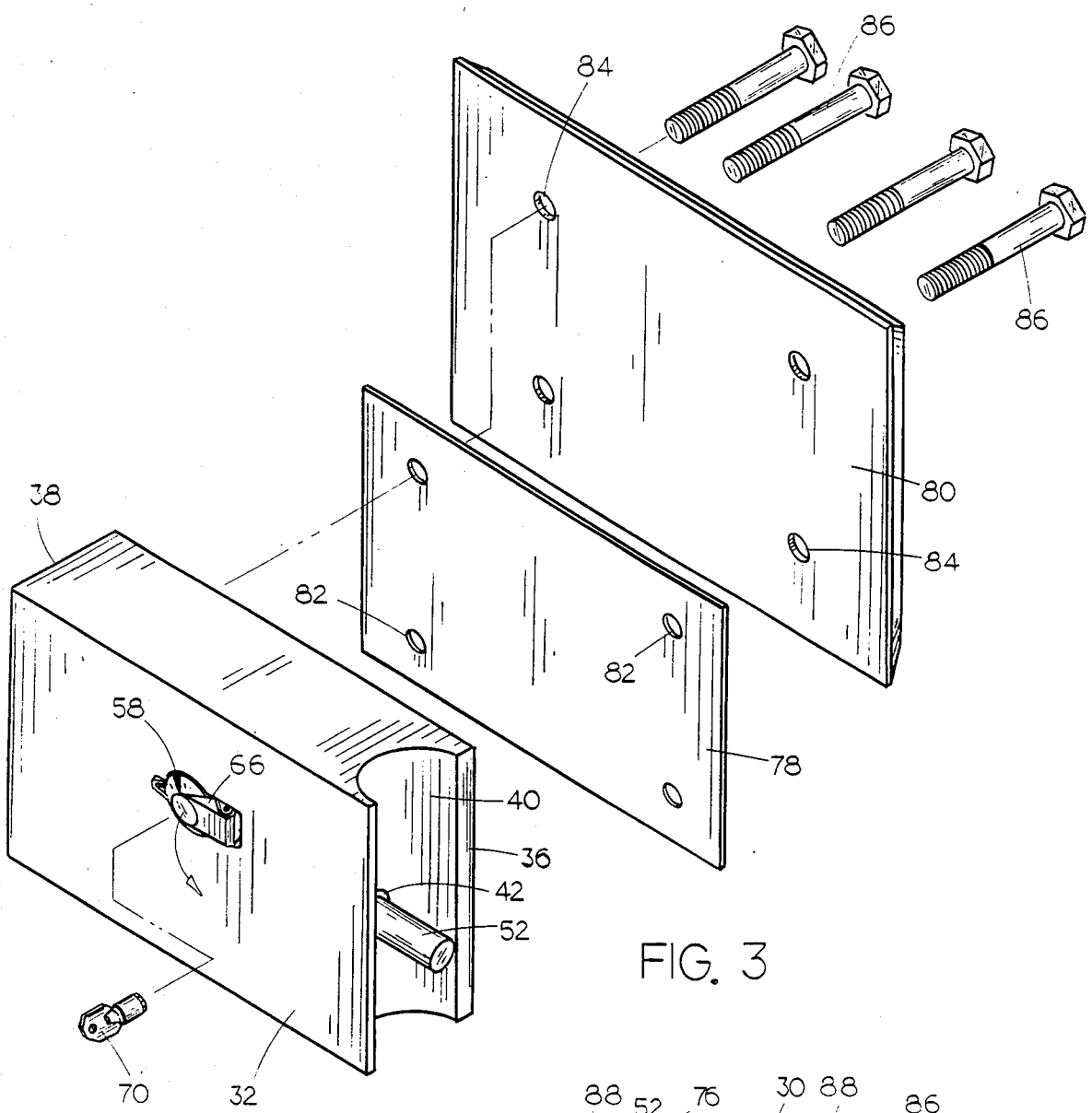
FIG. 3 is a perspective view of the lock system of the invention.
Figure 4:
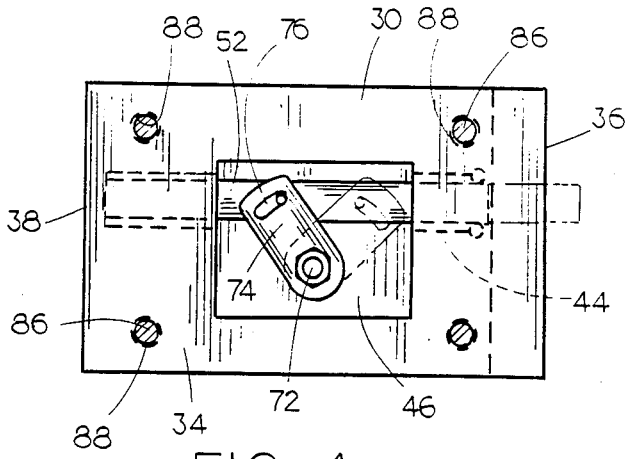
FIG. 4 is a rear elevational view of the lock body with dotted lines indicating the alternate positions for the lock shaft.

As shown in FIGS. 2–4, the lock device 10 includes a housing 30 having a front wall 32, a flat back wall 34 adapted for placement against the cargo door 12 and transversely spaced-apart opposite side walls 36 and 38. The side wall 36 includes a vertically extended groove 40 which is adapted for receiving the rotatable cargo door lock bar 18.

The lock bar receiving groove 40 preferably has a semi-cylindrical surface of a diameter which substantially conforms to the outer diameter 40 of the lock bar 18 for a close fit therebetween.

The housing side wall 36 furthermore has an opening 42 in communication with an elongated bore 44 which extends transversely through the housing. The bore 44 extends through a rearwardly opening lock chamber 46 in the housing which is preferably formed as a solid single piece aluminum casting. A pair of plastic sleeves 48 and 50 fit within opposite ends of the bore for slidably supporting an elongated lock pin 52. The end of bore 44 closest to side wall opening 42 is somewhat enlarged to accommodate a seal ring 54 which serves to keep foreign matter from the interior of the housing.

It can be seen in FIG. 2 that the vertical lock bar on the cargo door is provided with a hole 56 which is adapted to be registered with the side wall opening 42 when the lock bar 18 is rotated to its locked position. This enables the lock pin 52 to be transversely inserted through the aligned openings for securely locking the lock bar 18 in its locked position.

Movement of the lock pin 52 is controlled by a simple key operated lock mechanism 58. The lock mechanism 58 includes a generally cylindrical externally threaded member 60 insertable through a housing front wall opening 62 to the extent of engagement of the key receptacle 64 against front wall 32. The key receptacle 64 includes a hinged cover 66 which is pivotally movable between the open position of FIG. 2 and closed position of FIG. 3. A retaining nut 68 secures the lock mechanism 58 on the housing front wall.

A removable key 70 is insertable into the key receptacle 64 and is rotatable for rotating a lock shaft 72 within lock mechanism 58. A rocker arm 74 is secured to the lock shaft for rotation in unison with it. The free end of rocker arm 74 is connected to the lock pin 52 by a pin and slot connection 76 which effectively induces transverse sliding movement of the lock pin in response to turning movement of the key 70. Because a quarter turn of the key produces transverse movement of the free end of the rocker arm 74 which is longer than the stroke of the lock pin 52, the slot is transversely extended to afford some lost motion between the rocker arm 74 and lock pin 52. Limited rotation of the lock pin 52 accommodates whatever vertical movement is generated by the pivoting rocker arm. FIG. 4 illustrates the retracted unlocked positions of the rocker arm and lock pin in solid lines and shows the extended locked positions of these members in dotted lines.

To mount the housing 30 on cargo door 12, the back wall 34 of the housing is engaged against the cargo door with a spacer plate 78 inserted therebetween. A larger backing plate 80 is placed against the interior side of the door. Registered holes 82 and 84 are provided in the backing plate 80 and spacer plate 78 for receiving bolts 86 through registered drilled holes in the cargo door and into threaded openings 88 (FIG. 4) in the housing 30. It is preferred that the housing be installed on the door at an elevated position where it can easily be reached with a key but where it would be difficult to vandalize.

Whereas the specific dimensions of the parts of the locking device are not critical to the invention, a preferred form has a housing which is $3\frac{3}{4}$ inches tall, 6 inches wide and $1\frac{3}{4}$ inches deep. Lock pin 52 is provided as a $\frac{1}{2}$ inch diameter stainless steel shaft, 5 inches long. The bolt receiving openings 88 through the back wall of the housing are $1\frac{5}{8}$ inch deep. It is preferred that the lock mechanism 58 be of the type for receiving a cylindrical key. The key may be situated either above the lock pin as shown in FIG. 3 or below the lock pin as shown in FIGS. 2 and 4, the latter being preferred.

In operation, the lock mechanism 58 is permanently installed in closely adjacent relation to the rotatable cargo door lock bar 18. The lock pin 52 is easily transversely moved from its locked position inserted within the lock bar hole 56 to the retracted position in clearance relation from the lock bar by simply inserting key 70 into the key receptacle 64 and rotating the key in the desired direction. It is evident in FIG. 2 that when the lock pin is in the locked position thereof, the part of the lock pin disposed at the juncture between the lock bar 18 and housing 30 is fully concealed by the outward protrusions of housing side wall 36 forwardly of and behind the groove 40. Direct access to the lock pin with a hacksaw is clearly blocked. Access to the lock pin with other common tampering tools is similarly made so much more difficult, if not impossible. The significant amount of time that would be required for a vandal to figure out and tamper with the lock device of the present invention is believed to be an effective deterent to any attempted break-ins to a trailer equipped with the lock device.

Thus there has been shown and described a vehicle cargo door lock device which accomplishes at least all of the stated objects.

What is claimed is:

1. A lock system for a conventional vehicle cargo door having a vertical lock bar rotatably mounted thereon, said lock system comprising, a housing having a front wall, a flat back wall adapted for placement against a cargo door and transversely spaced-apart opposite side walls, said vertical lock bar being of the type mounted for rotation about its own vertical axis, one side wall of said housing including a vertically extended groove adapted for receiving the rotatable cargo door lock bar, said one side wall further having an opening in communication with said groove, means for securing said housing to a cargo door at a position with the rotatable lock bar received within said groove, an elongated lock pin, means for supporting said lock pin for transverse sliding movement in said housing and through said side wall opening into said groove for insertion into a registered hole in a cargo door lock bar, a key operated lock shaft supported on said housing generally perpendicular to the lock pin, and a rocker arm secured to said lock shaft for rotation therewith and having a free end connected to said lock pin for transverse movement of the lock pin in response to rotation of said lock shaft.

2. The lock system of claim 1 wherein said groove has a generally semi-cylindrical surface concentric to the vertical axis of said lock bar.

3. The lock system of claim 2 wherein the diameter of said semi-cylindrical surface conforms to the outer diameter of a cargo door lock bar for a close fit therebetween.

4. The lock system of claim 1 wherein said lock shaft is directed perpendicular to the housing front wall.

5. The lock system of claim 4 wherein said housing front wall has a key opening in registration with said lock shaft, and further comprising a removable key insertable through said key opening for engagement with the lock shaft to rotate said lock shaft.

6. The lock system of claim 5 further comprising a hinged cover on said housing front wall movable to a closed position over said keyhole opening.

7. The lock system of claim 1 wherein said means for supporting said lock pin comprises a transverse bore through said housing.

8. The lock system of claim 7 wherein said bore is oversized relative to said lock pin and said means for supporting said lock pin further comprises a sleeve liner in said bore.

9. The lock system of claim 7 further comprising seal means in said bore and engageable with said lock pin.

10. The lock system of claim 1 wherein said means for securing said housing to a cargo door comprises a backing plate, a plurality of registered holes through said backing plate and housing back wall and fastener means insertable through said registered openings for securing said back wall to said housing rear wall with a cargo door sandwiched therebetween.

11. In combination with a conventional vehicle cargo door having a vertical lock bar mounted thereon for rotation about its own vertical axis between locked and unlocked positions, a lock system comprising, a housing having a front wall, a flat back wall and transversely spaced-apart opposite side walls, one side wall of said housing including a vertically extended groove with an axis concentric with the vertical axis of the lock bar, and adapted for receiving the rotatable cargo door lock bar, said one side wall further having an opening in communication with said groove, said housing having its back wall secured to the cargo door at a position with the rotatable lock bar received within said groove, said rotatable lock bar having an opening positioned for registration with said side wall opening upon movement of the lock bar to the locked position thereof, an elongated lock pin, means for supporting said lock pin for transverse movement in said housing and through said side wall opening into said groove for insertion into the registered cargo door lock bar hole, a key operated lock shaft supported on the housing generally perpendicular to the lock pin, and a rocker arm secured to said lock shaft for rotation therewith and having a free end connected to said lock pin for transverse movement of the lock pin in response to rotation of the lock shaft.

12. The lock system of claim 11 wherein said housing front wall has a key opening in registration with said lock shaft and further comprising a removable key insertable through said key opening for engagement with the lock shaft to rotate said lock shaft.

* * * * *